US007159350B2

(12) United States Patent
L'Hotel

(10) Patent No.: US 7,159,350 B2
(45) Date of Patent: Jan. 9, 2007

(54) INFORMATION DISPLAY UNIT SUPPORT HAVING AT LEAST ONE PRESENTATION FACE

(76) Inventor: François L'Hotel, 61, Boulevard des Batignolles, 75008 Paris (FR)

( * ) Notice: Subject to any disclaimer, the term of this patent is extended or adjusted under 35 U.S.C. 154(b) by 156 days.

(21) Appl. No.: 10/137,620

(22) Filed: May 2, 2002

(65) Prior Publication Data

US 2002/0171023 A1 Nov. 21, 2002

(30) Foreign Application Priority Data

May 18, 2001 (FR) ..... 01 06569

(51) Int. Cl.
*G09F 15/00* (2006.01)

(52) U.S. Cl. ..... 40/610; 40/124.07; 40/606.12

(58) Field of Classification Search ..... 40/124.07, 40/124.09, 124.14, 539, 606.12, 606.18, 40/610, 750, 787, 650, 738; 248/174, 459
See application file for complete search history.

(56) References Cited

U.S. PATENT DOCUMENTS 3,508,734 A * 4/1970 Eiche ..... 248/459
3,759,477 A * 9/1973 Hird ..... 248/459
4,235,032 A * 11/1980 Robinson ..... 40/539
5,454,180 A * 10/1995 Volpe ..... 40/539
5,868,367 A * 2/1999 Smith ..... 248/174
6,347,772 B1 * 2/2002 L'Hotel ..... 248/174

FOREIGN PATENT DOCUMENTS

| | | |
|---|---|---|
| DE | 299 00 443 U1 | 6/1999 |
| FR | 2 574 968 A1 | 6/1986 |
| FR | 2 680 030 A1 | 2/1993 |
| FR | 2760880 A1 | 9/1998 |

OTHER PUBLICATIONS

Search Report, FR, 0106569, Feb. 6, 2002.

* cited by examiner

*Primary Examiner*—Joanne Silbermann
(74) *Attorney, Agent, or Firm*—Quarles & Brady LLP

(57) ABSTRACT

The support comprises at least one sheet of a substantially rigid and foldable material having the presentation face (111), an elastic member (110) for bending the presentation face (111) of the sheet and strips (39) for keeping the presentation face (111) of the sheet in the bent state, which strips (39) oppose the elastic member (110). The strips (39) opposing the elastic member (110) for keeping the presentation face (111) of the sheet bent are designed so that the force is exerted at discrete points distributed along the presentation face (111) of the sheet by a plurality of strips (39).

5 Claims, 4 Drawing Sheets

INFORMATION DISPLAY UNIT SUPPORT HAVING AT LEAST ONE PRESENTATION FACE

TECHNICAL FIELD

The field of the invention is that of information display unit supports for visual communication or advertising at the point of sale, called APS. The display units of the invention are columns which can be automatically folded up and unfolded with, advantageously, the ability to be transported and stored under excellent conditions, on the one hand, and to be very quickly installed on site, on the other.

DESCRIPTION OF THE BACKGROUND ART

More specifically, the invention relates to an information display unit support having at least one presentation face, comprising at least one sheet of a substantially rigid and foldable material having the said presentation face, stressing means for bending the presentation face of the sheet and holding means for keeping the presentation face of the sheet in the bent state, which holding means oppose the stressing means.

From a folded state, it is sufficient to start to unfold the support so that, under the action of the stressing means, it unfolds completely automatically. Of course, conversely, the support is folded up against the action of the stressing means.

Such types of display unit support are described in the documents FR 2760 880 and FR 2 795 217.

In these display unit supports, the presentation face is extended on either side of the lateral holding faces or strips that elastic return means spring closer together in order to force the presentation face to bend until abutment means oppose the elastic return means in order to keep the presentation face in the bent state; thus, one of the lateral holding faces, which is narrower than the presentation face, can come into abutment in the dihedron formed by the presentation face and the other of the lateral faces or strips.

These supports of the prior art, whilst they are of practical use, do have two drawbacks.

Most of the surface of the lateral holding faces or strips is of course wasted. The format of the sheets from which these supports are formed is limited. In the case of a support having two presentation faces of large width, i.e. 50 cm, the maximum width of a sheet being 120 cm, it is necessary to take two sheets, that is to say to make two cuts and two printing passes, which is obviously expensive.

In other words, and purely as an example, it is a problem to produce a double-sided support 50 cm in width from a single sheet 120 cm in width, while only 20 cm would therefore remain for the lateral holding strips.

The present invention aims to solve these difficulties.

SUMMARY OF THE INVENTION

For this purpose, the invention relates to an information display unit support of the type defined above, characterized in that the holding means opposing the stressing means for keeping the presentation face of the sheet bent in a curved position are designed so that their action is exerted according to a discrete distribution along the presentation face of the sheet.

In this way, holding levels are created in the support of the invention, contrary to the columns of the prior art in which the holding action is exerted continuously along the entire presentation face, by lateral faces or strips having the same length as the presentation face. Thus a substantial area of the sheet may be saved.

Preferably, the holding means comprise a plurality of strips advantageously hinged via one end to the sheet close to a lateral edge of the presentation face, having a length of less than the width of the presentation face of the sheet, the other end of the strips being designed, under the action of the stressing means, to butt against a folded-over border portion of the sheet.

Preferably, the stressing means comprise elastic return means fixed to the folded-over border portions of the sheet and to the holding means.

In the case of a display unit support having one information presentation face, the sheet of the presentation face has a width substantially equal to half that of a sheet of standard format.

Thanks to this, the production costs are reduced very roughly by a factor of two.

In the case of a support having two bent presentation faces, two sheets are provided which have, respectively, the two presentation faces of the same dimensions, these being cut from one and the same sheet of standard format.

This solution is more advantageous than that of a standard sheet having two presentation faces of a single piece which would be very difficult to fold because of the fact that the material of the sheet cannot undergo plastic flow.

In the latter case, a single series of holding strips, which are in abutment with the folded-over abutment border of each presentation face and are hinged to the two respective hinge borders of the two presentation faces, are also provided as discrete holding strips.

As a variant, the information display unit support may have two bent presentation faces and a single series of holding strips, which butt against each folded-over abutment border of each presentation face and are hinged to the two respective hinge borders of the folded-over portions of a sheet of standard format extending the presentation faces.

The information display unit support of the invention may also, in general, comprise a plurality of presentation faces, each with a border for the hinging of holding strips and a border for abutment of the holding strips, the hinge ends of the holding strips of a presentation face also being hinged to the abutment border of an adjacent presentation face.

Thus, the presentation faces are joined together in pairs by the hinge ends of holding strips.

BRIEF DESCRIPTION OF THE DRAWINGS

The invention will be more clearly understood with the aid of the following description of several embodiments of the display unit support, with reference to the appended drawing in which.

DETAILED DESCRIPTION

Figure 1:
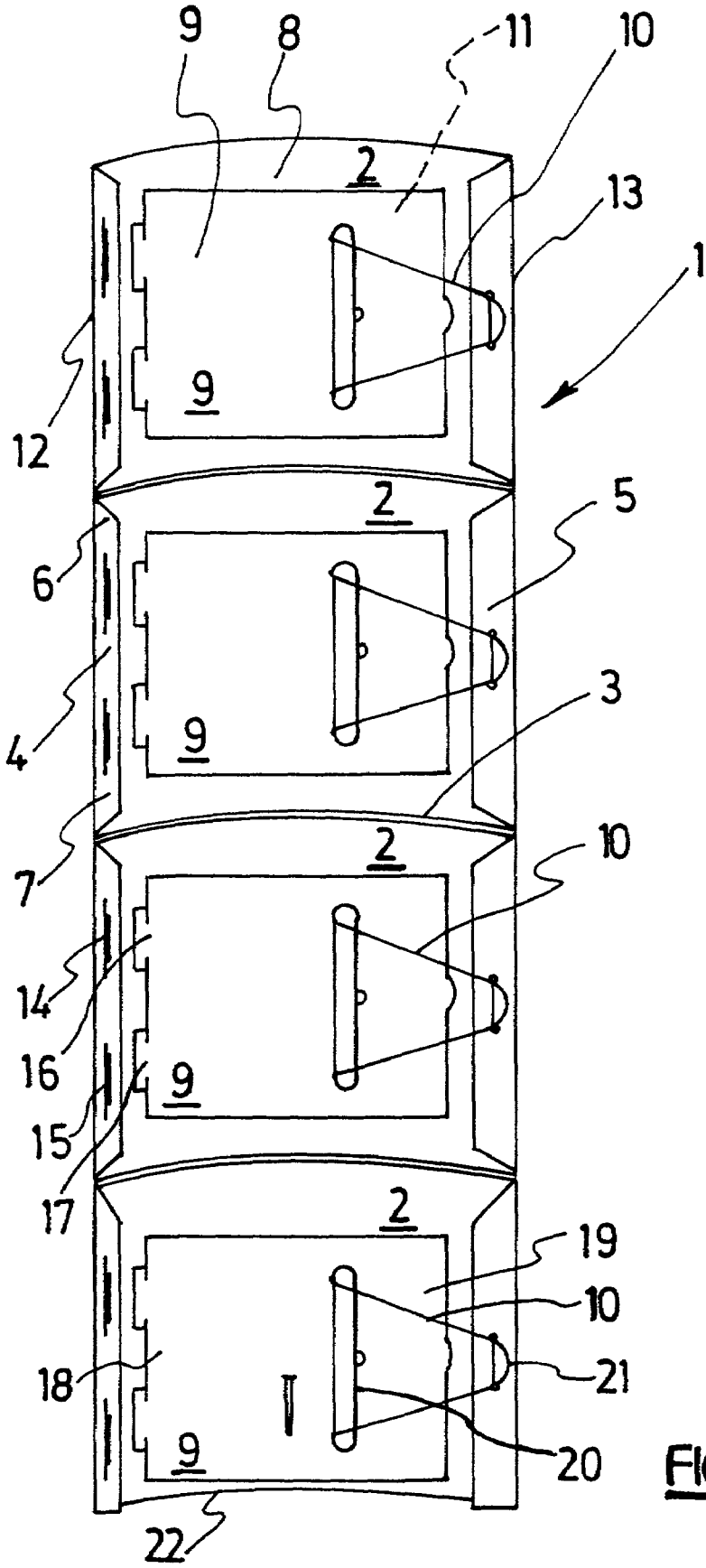
FIG. 1 is a rear view of a first embodiment of a single presentation face of the support.

The display unit support 1 in FIG. 1 is in the form of a vertical column which is deployed but which may be folded up on itself by turning down on each other the panels 2 formed in a sheet, here made of paperboard, which constitute it, there being in this case four panels adjacent to one another along thick folding lines 3, here therefore three in number. All the panels 2 are identical to one another. It is the front faces of the panels 2 which constitute the information presentation face 11 of the support column.

Each panel 2 is extended laterally, on both sides, respectively by two borders, one the hinge border 4 and the other the abutment border 5. At their two longitudinal ends 6, 7, the borders 4, 5 are notched in order to allow the panels 2 to be folded up one over another. The borders 4, 5, in the deployed state of the display unit, are folded over towards the rear face 8 of the panel 2 about portions of the lateral edges 12, 13 of the presentation face 11.

The borders 4, 5 serve respectively as hinge and abutment to a holding strip 9 which, in the display unit state, makes it possible to force the panel 2, in co-operation with an elastic member 10, to bend its presentation face 11 and keeps it in this state thanks to the abutment border 5 which may be presented as opposing the elastic forcing member 10.

It will straight away be noted that the holding strips 9, although in this case relatively wide, do not exert their action over the entire height of the column; this action is exerted according to a discreet distribution over this height, that is to say along the presentation face of the sheet.

Each holding strip 9 on one side is hinged to the associated hinge border 4 and, on the other side, is pulled by its elastic member 10 into abutment against the associated abutment border 5.

Each strip 9 has a length of less than the width of the panel 2 in order specifically to be able to bend it.

Close to the lateral edge 12, the hinge border 4 is pierced by two slits 14, 15 of the buttonhole type which receive two tabs 16, 17 of the button type, the said tabs projecting laterally from a hinge end portion 18 of the holding strip 9. A cut-out 20 of oblong shape for retaining the elastic member 10 has been made on the holding strip 9 closer to the opposed abutment end portion 19 of the holding strip 9, an associated cutout 21, in the form of a portion of an arc, having been formed in the abutment border 5 in order to retain the elastic member 10 on this border 5 and therefore on the panel 2.

From the unfolded, or deployed, state in FIG. 1, it is possible to fold up the display unit support by folding the panels 2, with their respective holding strips 9, over one another.

For this purpose, the panels 2 are flattened, by bending the elastic members 10, the abutment portions 19 of the holding strips 9 moving away from the abutment borders 5, and then the panels 2 are folded over one another about folding lines 3, alternately on one side and the other, in a concertina fashion, before keeping the assembly folded up in this way by any suitable means, for example an elastic member. Deployment takes place even more simply; by removing the elastic member which hold the support in the folded-up state, under the action of the elastic forcing members 10 which tend to bring the abutment portions 19 of the strips 9 of the abutment borders 5 of the presentation face 11 closer together and therefore to bend this face 11, the assembly is able merely to be unfolded, or to be deployed, in order to adopt the shape of the column in FIG. 1.

It will be noted that the bending of the lower panel 2, having a bearing edge 22, which is therefore curved, allows this panel 2, in combination with the unnotched lower edges of the lower borders 4, 5, to fulfil a supporting leg function. However, a true supporting leg such as those described in the prior documents indicated above, could be envisaged.

The sheet of the display unit support which has just been described, and which has only a single presentation face 11, has a width approximately equal to half that of a sheet of standard format.

Figure 2:
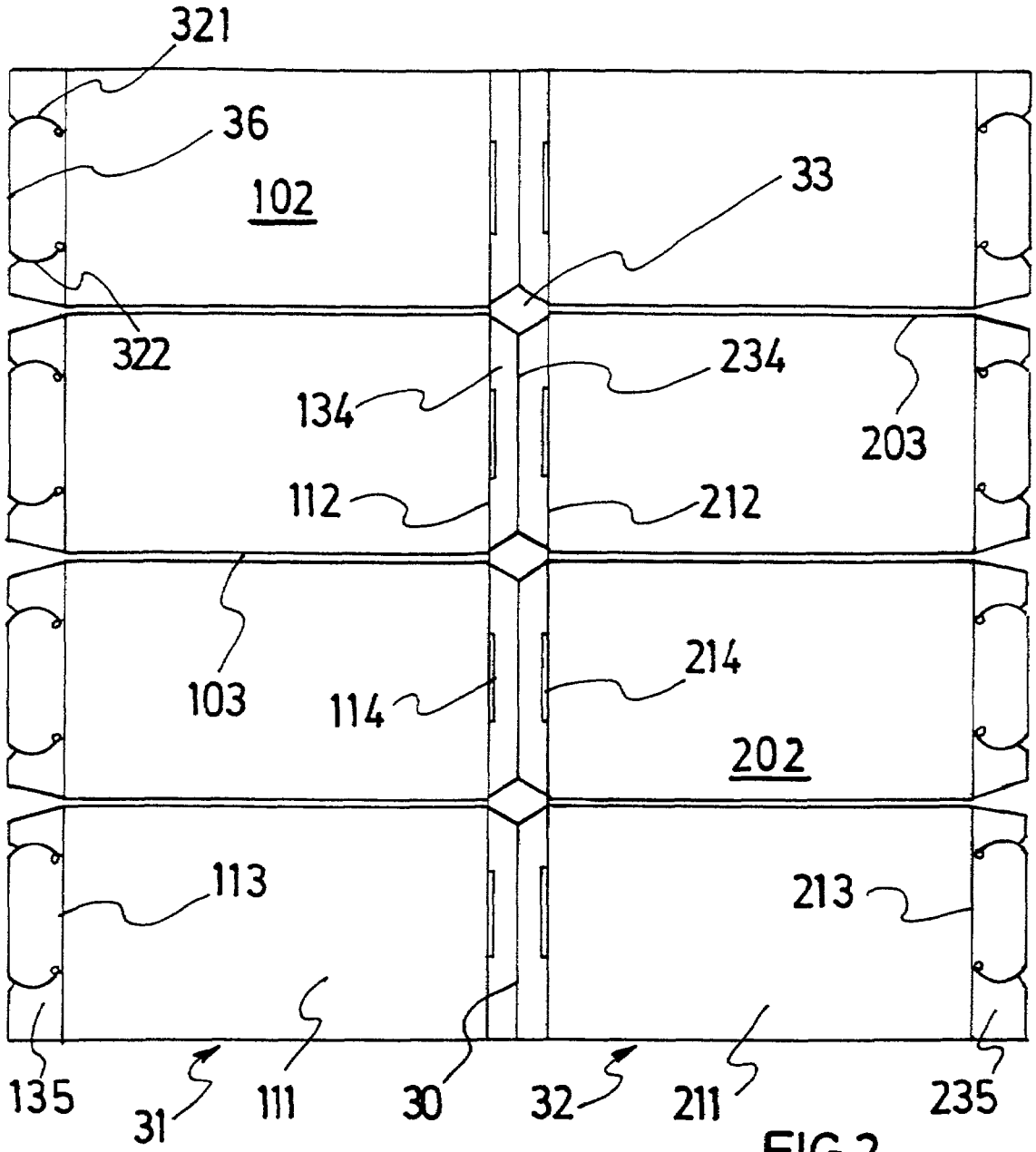
FIG. 2 is a view of the sheet in the flat state of a second embodiment of the support having two presentation faces.

The sheet in FIG. 2 is intended to produce an information support having two presentation faces 111 and 211, with two series of panels 102, 202 on either side of folding lines 103, 203, as previously. It is a sheet of standard format, in which prescored lines are made before they are cut into two sheets 31, 32 along a longitudinal mid-line 30 of the starting sheet.

About the mid-line 30, notched hinge borders 134, 234 have been prescored, as in the embodiment example in FIG. 1, which borders will be folded about the lateral edges 112 and 212 of the faces 111 and 211. The notches are obtained by diamond-shaped punching 33.

Hinge slits 114, 214 have been made along the lateral hinge edges 112, 212 in the hinge borders in order to hinge the holding strips 39. The hinge slits correspond to the buttonholes 14, 15 in the single-face embodiment in FIG. 1.

Notched abutment borders 135 and 235 have been prescored on the lateral sides away from the hinge borders 134, 234, which abutment borders will be folded over about the lateral edges 113 and 213 of the faces 111 and 211. Two cuts 321 and 322 in the form of a portion of an arc have been made starting from the edge 36 of the abutment borders 135 and 235, in order to retain the elastic holding members 110 (FIG. 4).

Holdings strips 39 (FIG. 3) of this second embodiment differ substantially from the previous ones. Firstly, they are much narrower, secondly, their hinge end 118 and abutment end 119 include retractable elements able to be inserted into the hinge slits 114, 214. Finally, their abutment end 119 fulfils, somewhat more suitably, the function of abutment opposing the forcing function of the elastic members 110.

Thus, the hinge end 118 of each holding strip 39 has a retaining bar 40, perpendicular to the longitudinal direction of the assembly and offering two internal retaining shoulders which are formed with the adjacent edges 41, 42 of the strip, engaging with external retaining shoulders, formed with the same edges of the strip and transverse edges of two small fins 43, 44 which can be folded down over the strip about this same edge 41, 42 in order to lock the strip and above all to grasp, between the bar 40 and the fins 43, 44, the two hinge borders 134, 234 of the two presentation faces 111, 112 (FIG. 4), after the fins have passed into the folded-down position through the corresponding hinge slits 114, 214 of the two sheets and after subsequent deployment of the fins.

Figure 4:
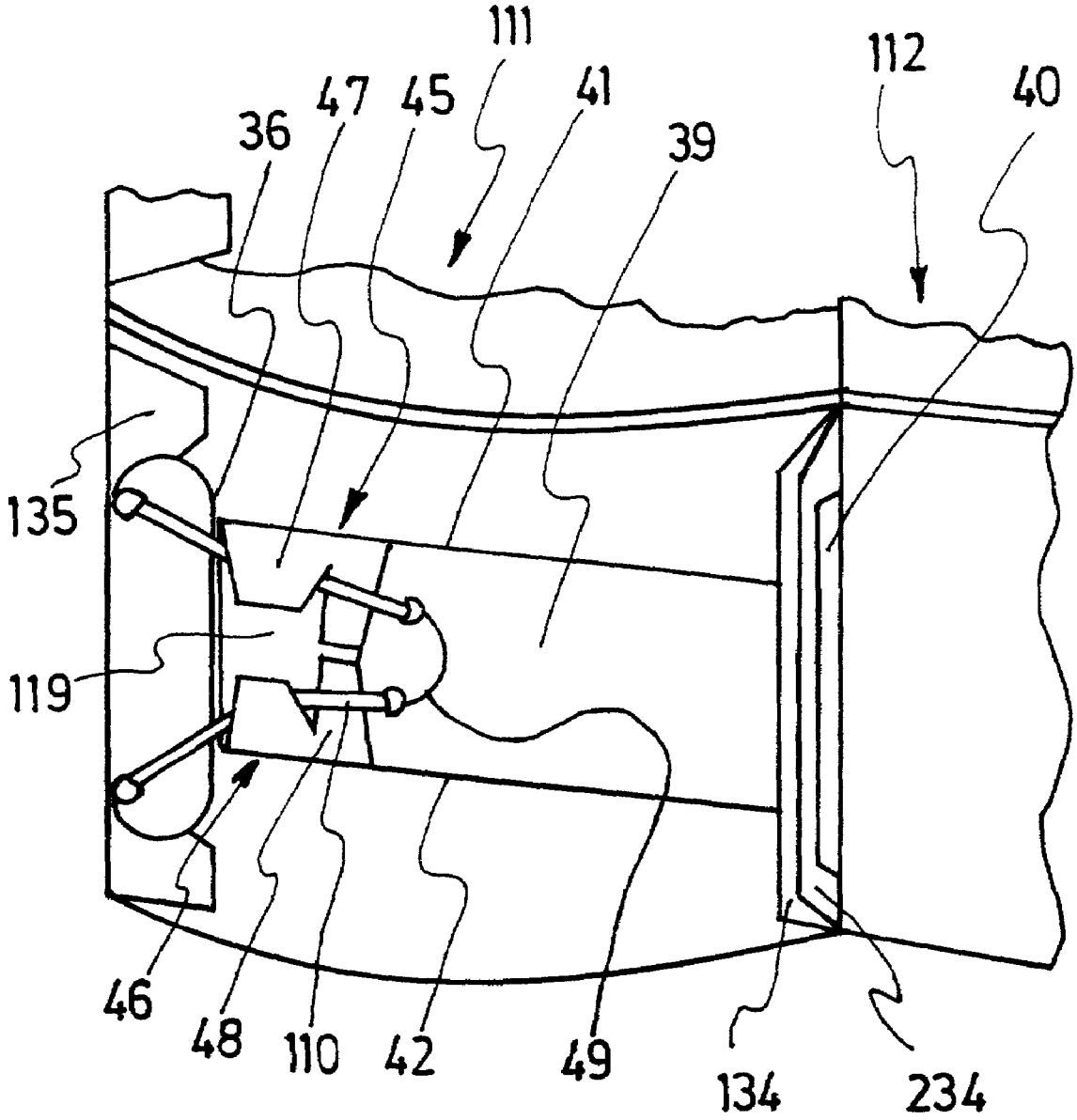
FIG. 4 is a rear view, on a larger scale, of part of the support in FIG. 2, in the display unit state.

The abutment end 119 of each holding strip 39 has, folded down about the longitudinal edges 41, 42, two small flaps 45, 46 for passage and retention of the associated elastic member 110, the latter being retained between the front portions 47 and the rear portions 48 and slipped under the rear portions 47 and over the rear portions 48 (FIG. 4).

Before the abutment end 119, the strip 39 has a cut 49 in the form of a circular arc in order to retain the elastic member 110 against the strip.

Because the elastic member 110 lies between the strip 39 and the front parts 47 of the flaps 45, 46, the end 119 of the strip has a certain thickness offering a good means of abutment to the edge 36 of the folded-own abutment borders 135, 235 of the two presentation faces 111, 112.

Figure 3:
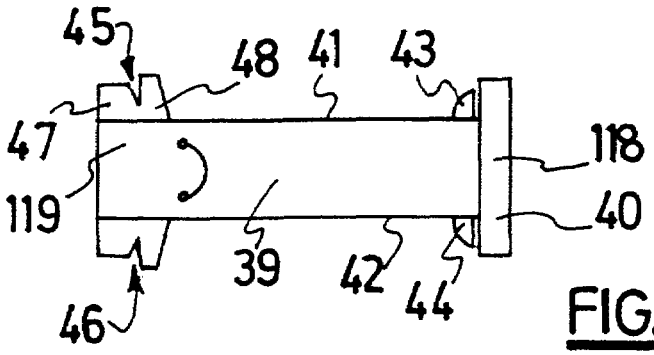
FIG. 3 is a view of a holding strip in the flat state of the support in FIG. 2.

The support in FIGS. 2–4 may be mounted quite easily. After having inserted the holding strips 39, in the manner indicated above, into the hinge slits 114, 214 and thus pinched together the hinge borders 134, 234, the two sheets 31, 32, thus hinged to each other, are folded down on each other and then, having attached each elastic member 110 to its associated holding strip 39, via the cut 49, it is attached to the two abutment borders 135, 235 superposed on one another, via the cuts 321, 322, thereby drawing the strip 39 towards the borders until the end 119 butts against the edges 36 of the borders, the faces 111 and 112 then both being bent into a curved position because of the shorter length of the holding strips 39 than the width of the faces 111, 112.

Figure 5:
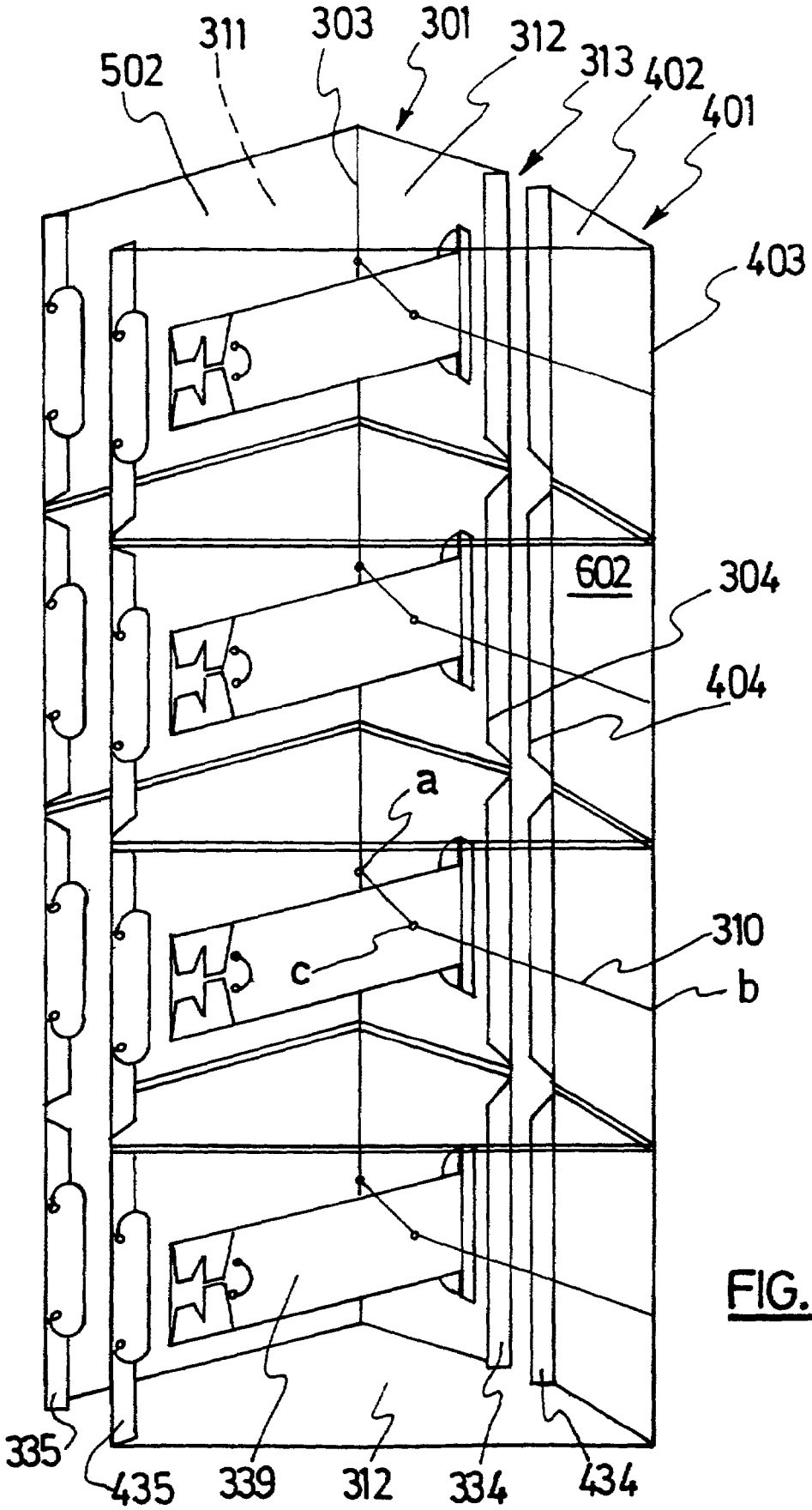
FIG. 5 is a perspective view, slightly exploded, of the rear of a third embodiment of the support of the invention in the display unit state.

The information support in FIG. 5 is quite similar to that in FIGS. 2–4 in the sense that it has, in particular, two individual presentation faces 311, 312 intended to be bent by the action of elastic forcing members, which are not shown but fulfil the same function as the elastic members 110, holding strips 339, in this case strictly identical to the holding strips 39, which are also hinged to two adjacent hinge borders 334, 434, which are also identical to the previous borders 134, 234, and two adjacent abutments borders 335, 435 which are again identical to the borders 135, 235.

The support in FIG. 5 differs, on the one hand, by the fact that the two individual information presentation faces 311, 312, of conventional width, belong to two sheets of standard format 301, 401 respectively, each comprising a first portion corresponding to the presentation face and a second portion 302, 402 which extends the presentation face and, on the other hand, by the fact that the second portions 302, 402 form a third presentation face 313, called a combined presentation face, joining the individual faces 311, 312 and held in a stressed state by the action of a second series of stressing wires 310, at each of the levels of the folding panels 502, 602, fixed at three points, two points a, b on the two intersecting edges 303, 403 and one point c on the holding strip 339.

The wires 310 may be made of plastic. Instead of wires, strips may be employed.

The invention claimed is:

1. Information display unit support comprising two sheets cut from one sheet of standard format, said two sheets having respectively two bent presentation faces (111, 211) of the same dimensions, stressing means (110) which are elastic for bending the presentation faces (111, 211) into non-folded, curved positions and strips (39) for keeping the presentation faces (111, 211) in the curved positions, the strips opposing the elastic stressing means (110), wherein the strips (39) are separate and discrete from the presentation faces (111, 211) and are each secured at one end by the elastic stressing means (110) for keeping the presentation faces (111, 211) bent in the curved positions, the strips being secured at an opposite end and along an edge of a respective presentation face by retainers for securing each strip to the respective presentation face, the strips (39) being spaced apart in a longitudinal direction of the presentation faces (111, 211) to provide a discrete distribution of holding forces along the presentation faces (111, 211) of the sheets.

2. Support according to claim 1, wherein said strips (39) are stressed into abutment against respective folded-over abutment borders (135, 235) of the two sheets (31, 32) and are hinged at two respective hinge borders (134, 234) of the two sheets (31, 32).

3. Support according to claim 1, wherein the strips (39) are stressed into abutment against respective folded-over abutment borders (135, 235) of the presentation faces (111, 211) and are hinged to two respective hinge borders (134, 234) of folded-over portions (102, 202) of the presentation faces (111, 211).

4. Support according to claim 3, in which the said folded-over portions (102, 202) extend the presentation faces (111, 211) to form side-by-side presentation faces.

5. Information display unit support having at least one presentation face (111), comprising at least one sheet of a substantially rigid and foldable material having the at least one presentation face (111), elastic stressing means (110) for bending the presentation face (111) of the sheet into a non-folded, curved position and holding means (39) for keeping the at least one presentation face (111) of the sheet in the curved position, the holding means (39) opposing the elastic stressing means (110), wherein the holding means (39) opposing the elastic stressing means (110) for keeping the at least one presentation face (111) of the sheet bent in the curved position include holding strips (39) which are strips separate and discrete from the at least one presentation face (111) which are held at least at one end by the stressing means (110) in abutment with the at least one presentation face (111), and which are secured at an opposite end of the holding means and along an edge of the at least one presentation face by retainers for securing the holding strips to the at least one presentation face, the holding strips (39) being spaced apart in a longitudinal direction of the presentation face (111), to provide a discrete distribution of holding forces along the presentation face (111) of the sheet, and wherein the at least one presentation face (111) further comprising a plurality of presentation faces (111, 211), each with a hinging border (134, 234) for the hinging of the holding strips (39) and an abutment border (135, 235) for abutment of the holding strips (39), the holding strips (39) including abutment ends (118) for being held by the elastic stressing means (110) in abutment with the abutment border of an adjacent presentation face.

* * * * *